US006364312B1

(12) United States Patent
Ramcke

(10) Patent No.: US 6,364,312 B1
(45) Date of Patent: Apr. 2, 2002

(54) METHOD AND ARRANGEMENT FOR REMOVING AIR INCLUSIONS WHEN FORMING STACKS FROM SHEETS

(75) Inventor: Bernd Ramcke, Hamburg (DE)

(73) Assignee: E. C. H. Will GmbH (DE)

( * ) Notice: Subject to any disclaimer, the term of this patent is extended or adjusted under 35 U.S.C. 154(b) by 0 days.

(21) Appl. No.: 09/536,323

(22) Filed: Mar. 27, 2000

(30) Foreign Application Priority Data

Mar. 27, 1999 (DE) ..... 199 14 068

(51) Int. Cl.[7] ..... B65H 39/10

(52) U.S. Cl. ..... 271/299; 271/279; 271/210; 271/174; 271/211; 414/790.9; 414/789.1

(58) Field of Search ..... 271/279, 299, 271/210, 211, 194, 183; 414/789.1, 788.9, 790.9, 793, 794.4

(56) References Cited

U.S. PATENT DOCUMENTS

| | | | | | |
|---|---|---|---|---|---|
| 1,743,921 | A | * | 1/1930 | Kerley | 271/211 |
| 2,624,577 | A | * | 1/1953 | Peugnet | 271/210 |
| 2,745,538 | A | * | 5/1956 | Lamb | 271/299 |
| 3,411,829 | A | * | 11/1968 | Albright | 271/279 |
| 3,556,519 | A | * | 1/1971 | Keller | 271/211 |
| 3,581,912 | A | | 6/1971 | Bennett | |
| 3,842,995 | A | * | 10/1974 | Dooley | 271/210 |
| 4,069,541 | A | * | 1/1978 | Williams et al. | 15/321 |
| 5,259,608 | A | * | 11/1993 | Pollich | 271/183 |
| 5,445,372 | A | | 8/1995 | Blaser et al. | |
| 5,470,420 | A | * | 11/1995 | Yokajty | 271/183 |
| 6,116,593 | A | * | 9/2000 | Cote et al. | 271/211 |

FOREIGN PATENT DOCUMENTS

| | | | |
|---|---|---|---|
| DE | 9 38 698 | 2/1956 | |
| DE | 1 906 696 | 9/1970 | |
| DE | 26 27 390 | 3/1977 | |
| DE | 34 03 209 A1 | 8/1984 | |
| DE | 36 01 293 A1 | 7/1987 | |
| DE | 91 15 032.9 | 2/1992 | |
| DE | 42 01 480 A1 | 7/1993 | |
| DE | 195 01 874 | 7/1996 | |
| DE | 196 35 401 C1 | 8/1996 | |
| DE | 195 23 699 A1 | 1/1997 | |
| DE | 197 53 890 | 7/1999 | |
| GB | 885351 | 12/1961 | |
| GB | 914468 | 1/1963 | |
| JP | 404209158 A * | 7/1992 | 271/211 |

OTHER PUBLICATIONS

Yamamura KO, "Accumulating Device For Sheet–State Material", Patent Abstracts of Japan, vol. 016, No. 553, Jul. 30, 1992, Publication No. 04 209 158.

* cited by examiner

*Primary Examiner*—H. Grant Skaggs
(74) *Attorney, Agent, or Firm*—Venable; George H. Spencer; Robert Kinberg

(57) ABSTRACT

A method and arrangement are provided for removing air inclusions between sheets in a stack when forming the stack from sheets fed successively by a sheet feeder to the stack to be formed and deposited thereon in a sheet feeding region. Air out is suction out of the spaces between the sheets in the sheet-feeding region.

23 Claims, 4 Drawing Sheets

METHOD AND ARRANGEMENT FOR REMOVING AIR INCLUSIONS WHEN FORMING STACKS FROM SHEETS

CROSS-REFERENCE TO RELATED APPLICATIONS

Priority is claimed with respect to Application No. 199 14 068.5 filed in Germany on Mar. 27, 1999, the disclosure of which is incorporated herein by reference.

BACKGROUND OF THE INVENTION

The invention relates to a method for removing air inclusions between sheets in a stack which is formed by successively feeding and depositing sheets on the stack to be formed. The invention furthermore relates to an arrangement for removing air inclusions when forming stacks from sheets, the arrangement comprising a feeding device for successively feeding sheets to the stack to be formed and on which they are deposited.

As used herein, sheets are understood to mean sheets of paper, carton or plastic, such as foils. The size of these sheets can vary over a wide range. Thus, it is possible with the invention to process sheets of standard copying paper size, as well as sheets that are smaller or several times that size.

During the production of sheets, the sheets are frequently gathered into stacks (also called reams) and are then transported to a further processing location where they are wrapped, for example, with wrapping material. The transport of wrapped stacks requires particular care because individual sheets or whole layers of sheets can easily shift owing to the air inclusions between sheets when the stack is formed. As a result, the stack will lose its desired and mostly quadratic configuration. During the further transport, this can lead to damage that can render the complete stack unusable.

Methods for removing air inclusions in this way are disclosed, for example, in German Patents 195 23 699 A 1 and 34 03 209 A 1, which methods call for pressing or stroking the air out of the completed stacks However, such methods are not optimal.

SUMMARY OF THE INVENTION

It is an object of the invention to provide a new and advantageous method, as well as an arrangement, for creating stacks without disturbing air inclusions.

The above and other objects are achieved in accordance with the invention by the provisions of a method for removing air inclusions between sheets in a stack when forming the stack from sheets fed successively by a sheet feeder to the stack to be formed and deposited thereon in a sheet feeding region, comprising: auctioning air out of spaces between the sheets in the sheet-feeding region.

The invention thus provides for suctioning air from the spaces between sheets in the sheet-feeding region where sheets are fed from a sheet feeder for forming a stack of sheets. The mention of suctioned-out air in the following refers to air, which can lead to damaging air inclusions between sheets, or air that is already present between sheets.

One advantageous modification of the method according to the invention consists in suctioning the air from the stack surface located opposite the sheet-feeder. Another advantageous embodiment according to the invention provides that air is suctioned from at least one of the stack surfaces (side surfaces) that extend parallel to the sheet-feeding direction. If two side-by-side arranged stacks are formed, then air can be suctioned respectively from one side surface of a stack by a suction device that is arranged between the stacks. A particularly advantageous embodiment of the method according to the invention provides that the devices for suctioning off the air also perform vibrating movements for aligning the stack surfaces. The effect of suctioning off interfering air can be further improved with the aid of another modification of the invention in that the air above the feeding region is suctioned off because this will remove in a gentle manner the interfering air that is also supplied by the sheets. In the process, air can be sucked through openings in the limiting walls into hollow spaces of suction devices, so-called vacuum chambers.

According to a particularly advantageous modification of the method for suctioning air from the side surfaces of two adjacent stacks, the limiting walls for the hollow if space (vacuum chamber) of a suction device installed between two stacks approach each other and make contact in some locations and are connected in those locations. By providing additional openings with larger cross sections for the air to flow through in the regions of the limiting walls that make contact, undesirable air pressure differences that may occur on both sides of the hollow body can balance out. In order to homogenize the suctioning, it may also be helpful if the flow of air in the hollow space is at least in part reduced or interrupted.

According to another aspect of the invention there is provided an arrangement for removing air inclusions between sheets in a stack during formation of the stack from successively fed sheets deposited on top of one another in a sheet feeding region, comprising: a feeding device for feeding the sheets successively and depositing the sheets on top of one another in the sheet feeding region; and at least one suction device arranged in the sheet feeding region for removing air from intermediate spaces between the sheets.

The invention is preferably used for a feeding device that supplies and deposits the sheets from the side onto the stack, which feeding device can be embodied as a conveyor belt. According to a modification of the invention, the suction device can be characterized by a suction device for removing air from the spaces between sheets, which is assigned to a stack surface opposite the feeding device. However, it can also be assigned to at least one of the stack surfaces that extend parallel to the sheet-feeding direction, preferably both surfaces (side surfaces).

A suction device can be provided with an alignment surface provided with air openings for aligning the sheets of a stack surface. An alignment surface of this type preferably can be combined with a vibrating drive that causes the alignment surface to vibrate.

According to a preferred modification of the invention, an alignment surface can be designed as a limiting wall for a hollow space connected to a vacuum source. When forming two side-by-side arranged stacks to which sheets are respectively supplied, it is particularly advantageous if the hollow space for the suction device has limiting walls with air openings, which are respectively assigned to one side surface of a stack. Such an arrangement for a suction device is particularly space saving and requires little expenditure. The limiting walls for such a suction device can make contact in some locations and can be connected in those locations. The limiting walls preferably can be provided with further openings in the contacting locations, wherein these additional openings have larger cross sections than the other air openings. The hollow space for another embodiment according to the invention can be provided in part with reducing elements for reducing or interrupting the air flow.

According to another embodiment of the invention, the situation concerning air inclusions in the sheet-feeding region can be further improved by arranging an additional suction device above the sheet-feeding region, so that air arriving with the sheets is also suctioned off above the stack.

The invention has the advantage that air inclusions are for the most part prevented during the stack formation. Thus, a later compressing of the stack, which always requires a considerable expenditures is not necessary. The limiting surfaces for the suction devices can also serve as alignment surfaces for the stacks, provided they are induced to vibrate.

BRIEF DESCRIPTION OF THE DRAWINGS

The invention is explained in further detail with the aid of an exemplary embodiment.

DETAILED DESCRIPTION OF THE INVENTION

Figure 1:
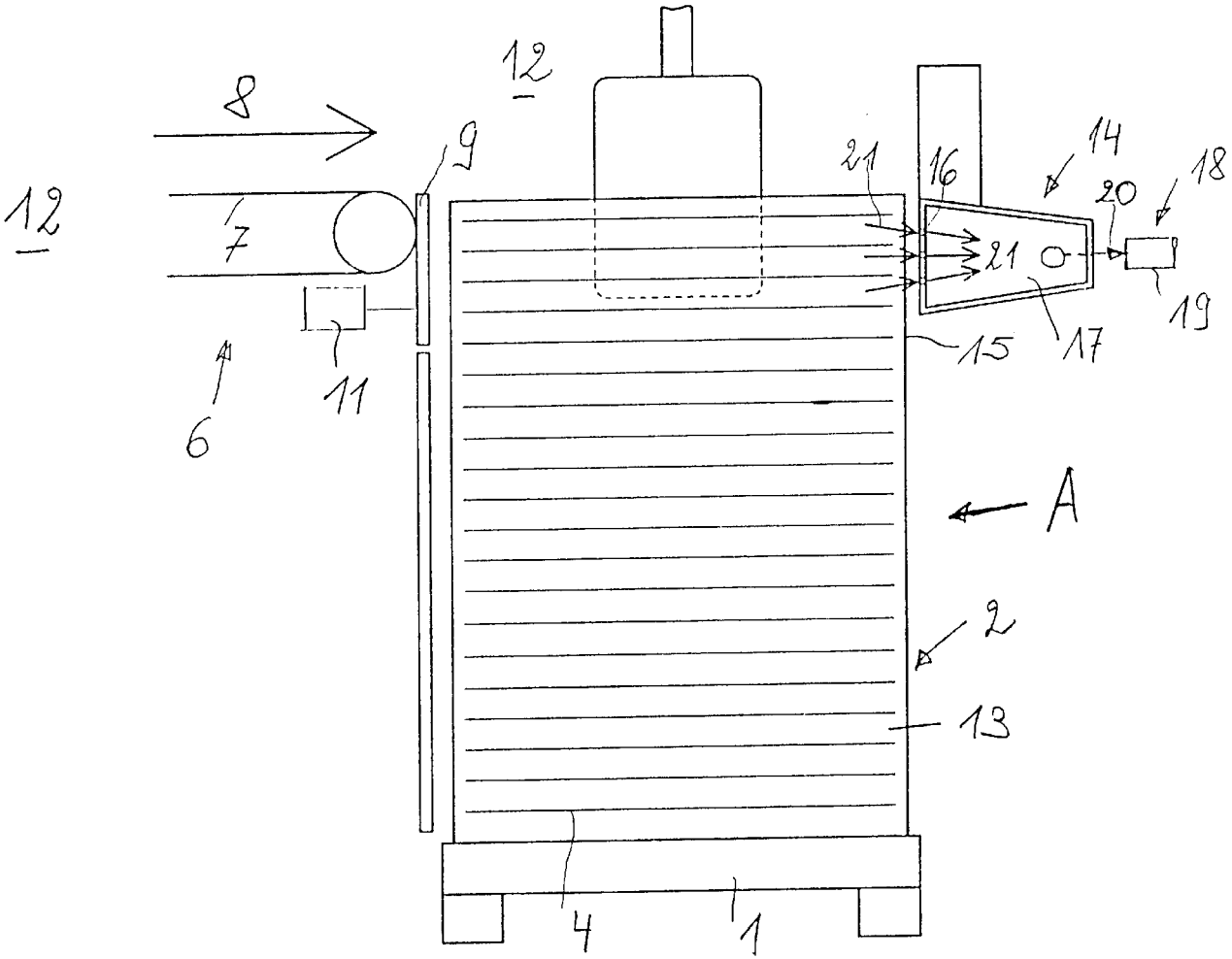
FIG. 1 is a side view of a station for supplying sheets to two stacks.
Figure 2:
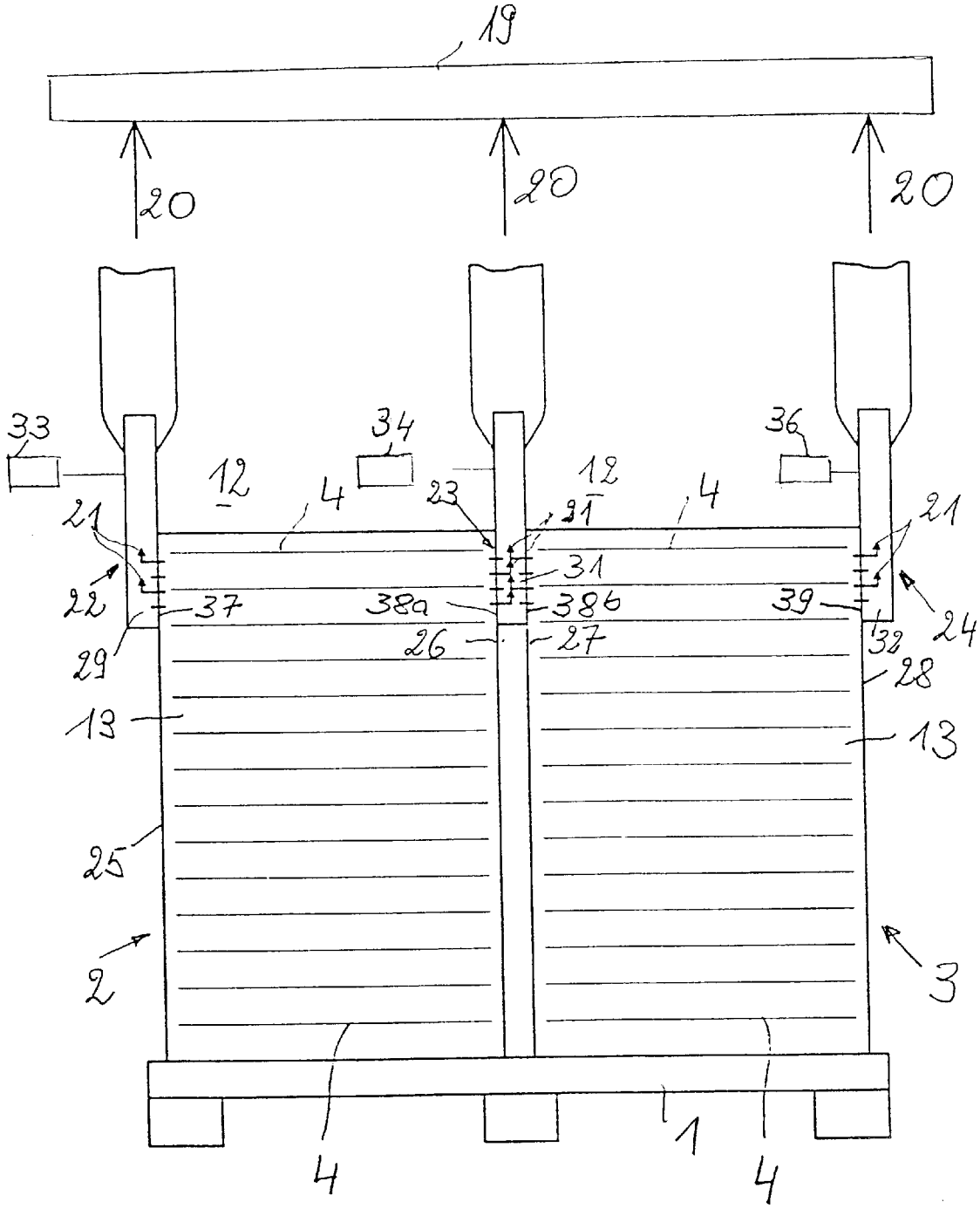
FIG. 2 is a view according to arrow A in FIG. 1.

Referring to FIGS. 1 and 2, there is shown a pallet 1, which holds two stacks 2 and 3, composed of sheets 4. The sheets can be sheets of a normal copy paper format or a smaller or larger format. The sheets can also be made of carton or plastic. Sheets 4 in the drawing are shown with large intermediate spaces 13, which do not exist in reality. Rather, the sheets in the stack are stacked tightly one above the other. They are supplied successively and from the side by feeding devices 6 in the form of conveyor belts 7 (only one such feeding device is visible in FIG. 1) in the direction of arrow 8 and are deposited on stacks 2 and 3. Conveyor belts 7 are discharge belts for a sheet-producing machine that is not shown here, e.g. a so-called small-format cutter of the known type SLK by the assignee herein, or a cutter for larger formats, such as the type FFS by the assignee herein, which produces so-called foil sheets. A standard lifting device that is not shown here lowers pallet 1, such that the stack top surfaces maintain at least approximately the same heights, relative to conveying belts 7. An alignment plate 9 is located below conveyor belts 7, which plate is stimulated to vibrate by a vibrating drive 11 in order to align sheets 4 in stacks 2 and 3 in the sheet-feeding region 12. Suction devices for removing, meaning suctioning off, damaging air inclusions in the spaces 13 between sheets 4 are arranged in sheet-feeding region 12 of feeding device 6. In the following, the air inclusions that are suctioned off are simply referred to as "air."

A first suction device 14 is located opposite feeding device 6 and comprises a negative pressure box 17 that is assigned to the surfaces 15 of stacks 2 and 3 and is provided with air holes, This negative pressure box is connected to a negative pressure source 18, e.g. in the form of a ventilator (fan) 19. The air that is suctioned out of the intermediate spaces 13 (air inclusions) travels in a direction of arrows 21 through air holes 16 into negative pressure box 17 and from there in the direction of arrows 20 to fan 19.

Further suction devices 22, 23 and 24 are located in sheet-feeding region 12, as shown in particular in FIG. 2. These suction devices are assigned to those surfaces 25, 26, 27 and 28 of stacks 2 and 3, which extend parallel to the feeding direction for sheets 4 (corresponding to arrow 8 in FIG. 1). The aforementioned suction devices include negative pressure boxes 29, 31 and 32, which are provided with air openings that are not shown in FIG. 2 and are connected via lines to fan 19, as shown with arrows 20. Thus, the suctioned-off air can flow in the direction of arrows 21 into the negative pressure boxes and from there in the direction of arrows 20 to fan 19. The negative pressure boxes 29, 31 and 32 are respectively stimulated to vibrate by vibration drives 33, 34 and 36. Thus, suction surfaces 37, 38*a*, 38*b* and 39 not only serve to suction off the enclosed air, but also to align the stack side surfaces 25, 26, 27 and 28. Suction, devices 22 and 24, adjacent the outer side surfaces 25 and 28 of stacks 2 and 3, can essentially have the same design. Suction device 23, arranged between the stacks 2 and 3, is described in further detail in the following.

Figure 3:
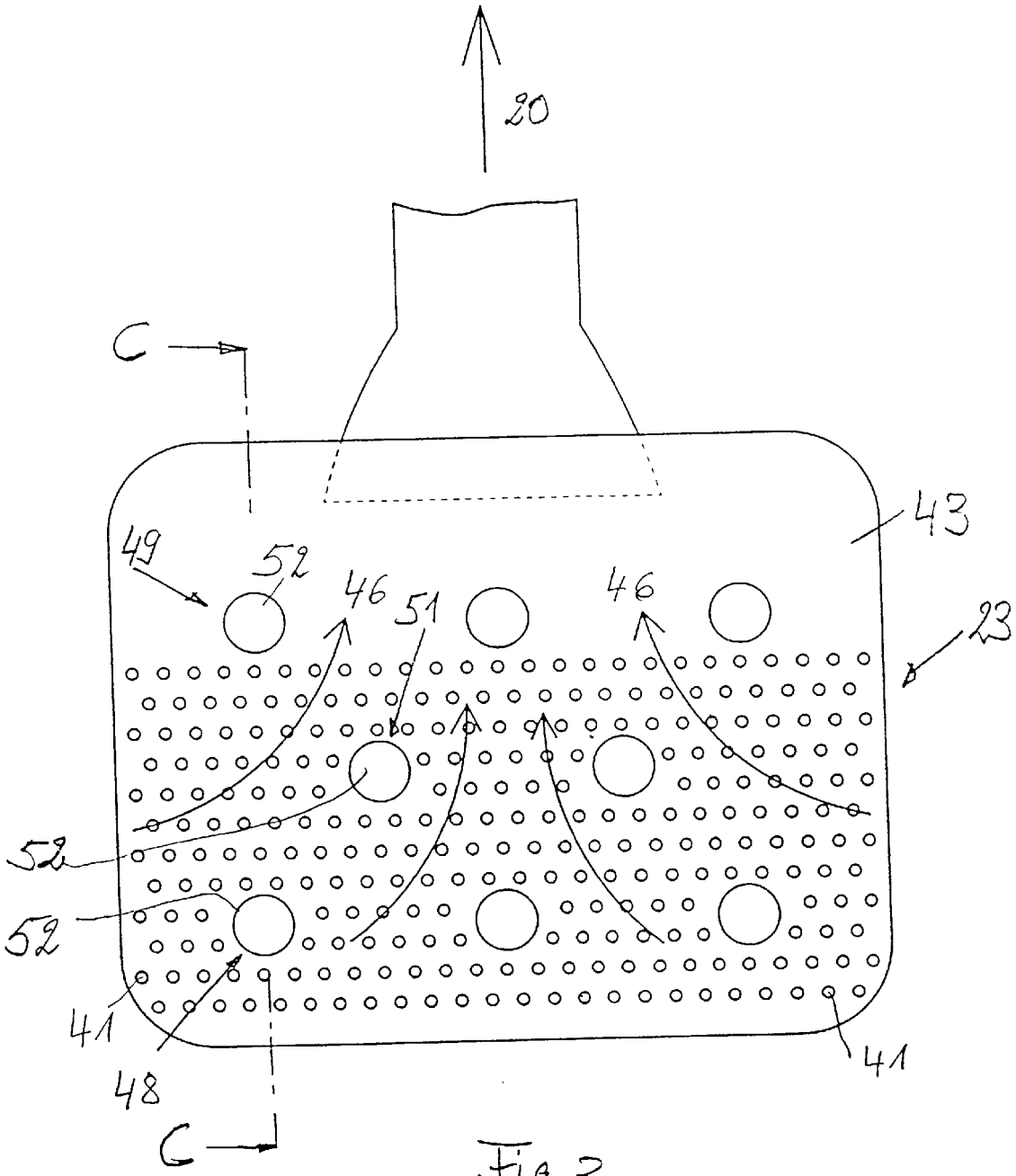
FIG. 3 is an enlarged view showing details of a suction device that is arranged between the stacks.
Figure 4:
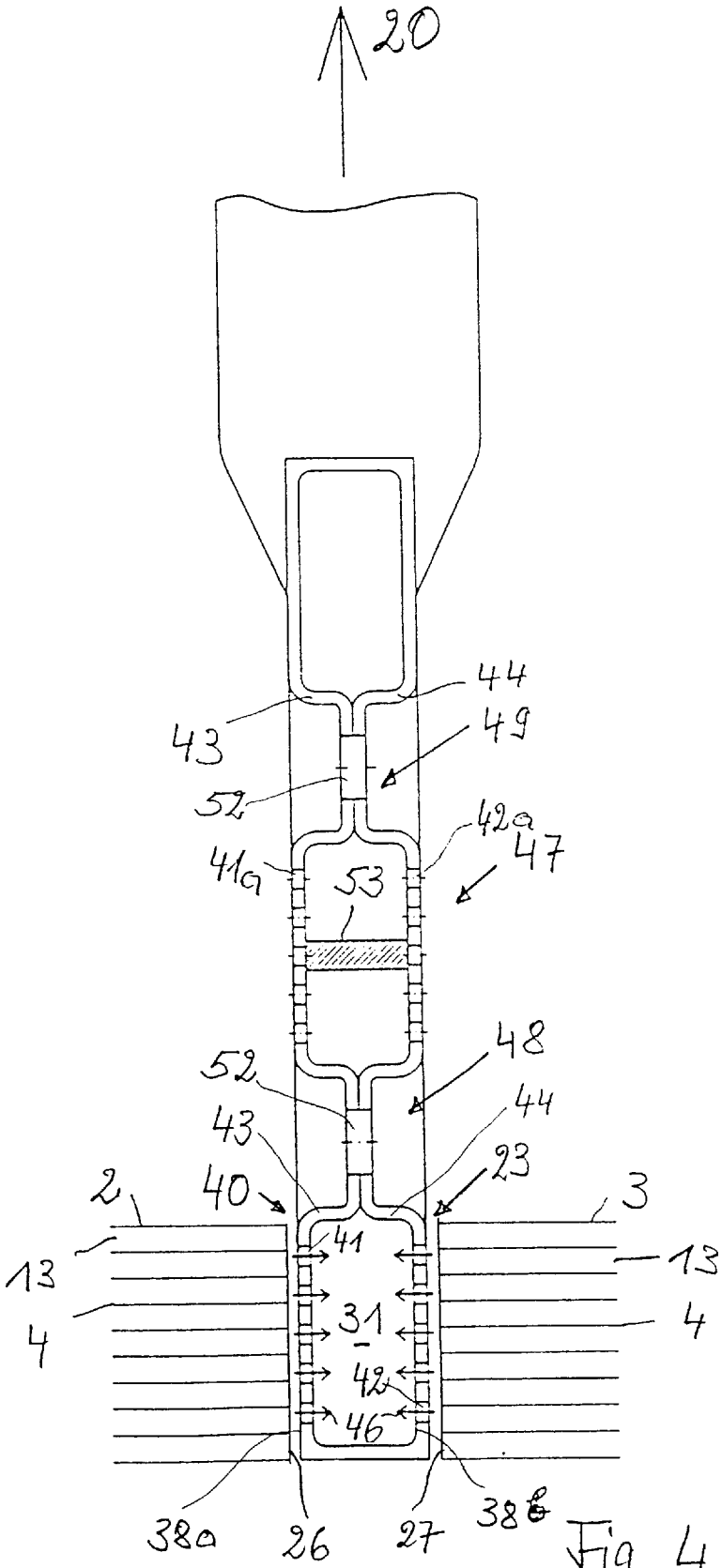
FIG. 4 is a section (not to scale) through the suction device according to FIG. 3, corresponding to the line 4—4.

FIGS. 3 and 4 show the negative pressure box 31 for suction device 23, into which air flows in a first suction region 40 through air openings 41, 42 in the limiting walls 43 and 44 that are designed as suction surfaces 38*a*, 38*b*. The air flows in the direction of arrows 46 from the intermediate spaces 13 in stacks 2 and 3. Additional air openings 41*a* and 42*a* are provided in another suction region 47, above stacks 2 and 3. Air that is carried along by the sheets is suctioned from these openings, which further reduces the danger of air inclusions. Limiting walls 43, 44, which simultaneously serve as alignment surfaces for the side surfaces 26, 27 of stacks 2 or 3, are pulled in at some locations and approach each other until they make contact in the regions 48, 49, 51 (51 can be seen only in FIG. 3). The limiting walls can be connected in those regions. The contact regions contain air openings 52 with considerably larger cross sections than the air openings 41, 42. These permit the equalization of pressure if undesirable, differing pressures form on both sides of the suction device 23 during the vibration of the limiting walls and the suctioning out of air. A stop or reducer 53 also functions to improve the air guidance in the suction device 23 by reducing or interrupting the air flow.

If the invention for removing air inclusions is used for one stack only, then the special design of the suction device 23 can be omitted and it can be designed in the same way as the suction device 24. In that case, only two side suction devices, corresponding to 22 and 24, are provided in addition to the frontal suction device.

With the above-described method and arrangement, it is possible to sufficiently reduce the formation of air inclusions from the start, namely during the stack formation. The limiting walls of the suction devices, which are provided with suction openings for this, can additionally be used advantageously for aligning the stack surfaces, provided they are made to vibrate.

The invention has been described in detail with respect to referred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention,

What is claimed is:

1. A method for removing air inclusions between sheets in a stack when forming the stack from sheets fed successively by a sheet feeder to the stack to be formed and deposited thereon in a sheet-feeding region, comprising:

feeding sheets to two side-by-side arranged stacks in a sheet-feeding region;

arranging a suction device between the two side-by-side arranged stacks; and suctioning air out of the spaces between the sheets in the sheet-feeding region with the suction device from at least one side surface of a stack which extends parallel to a sheet-feeding direction.

2. The method according to claim 1, wherein the suctioning step includes suctioning air from a stack surface located opposite the sheet feeder.

3. The method according to claim 1, wherein the suctioning step is conducted with the aid of a suctioning device, and the method includes vibrating the suctioning device and arranging the vibrating suctioning device so that vibrating movements of the vibrating suctioning device assist in aligning the stack surfaces.

4. The method according to claim 1, and further including suctioning off air above the feeding region.

5. The method according to claim 1, wherein the suctioning step is conducted with the aid of a suctioning device having a hollow space, and the suctioning step includes suctioning the air through openings into the hollow space of the suction device.

6. The method according to claim 5, including at least one of partially reducing and interrupting air flow inside the hollow space.

7. The method according to claim 1, wherein the suctioning step includes suctioning air from a stack surface located opposite the sheet feeder and from both side surfaces of the stack parallel to a sheet feeding direction.

8. A method for removing air inclusions between sheets in a stack when forming the stack from sheets fed successively by a sheet feeder to the stack to be formed and deposited thereon in a sheet-feeding region, comprising:

feeding sheets to two side-by-side arranged stacks;

arranging a suctioning device into the hollow space between the stacks, the suctioning device having a hollow space that sucks the air through openings; and suctioning air out of the spaces between the sheets in the sheet-feeding region from respectively one side surface of each stack with the suctioning device.

9. The method according to claim 8, including providing the suctioning device with limiting walls defining the hollow space and having regions approaching each other, making contact in some locations and connecting in those locations.

10. A method according to claim 9, including providing the limiting walls in the region of making contact with additional air flow openings having larger cross sections than the other openings.

11. An arrangement for removing air inclusions between sheets in a stack during formation of the stack from successively fed sheets deposited on top of one another in a sheet-feeding region, comprising:

two feeding devices, each-for feeding the sheets successively and depositing the sheets on top of one another in the sheet-feeding region for forming respective stacks separated by a space; and at least one suction device arranged in the sheet-feeding region, with one of the at least one suction devices arranged in the space between the respective stacks for removing air from intermediate spaces between the sheets, and including two limiting walls with air openings and enclosing a hollow space connectable to a source of low pressure, a respective one of the limiting walls being located adjacent to one side surface of the respective stacks.

12. The arrangement according to claim 11, wherein the feeding device supplies sheets from a side and deposits the sheets on the stack.

13. The arrangement according to claim 11, wherein the feeding device comprises a conveyor belt.

14. The arrangement according to claim 11, wherein one of the at least one suction device is arranged adjacent a surface of the stack located opposite the feeding device.

15. The arrangement according to claim 11, wherein one of the at least one suction devices is arranged adjacent to a surface of the stack which extends parallel to a direction of sheet-feeding from the sheet feeder to the stack.

16. The arrangement according to claim 11, wherein one of the at least one suction devices has an alignment surface provided with air openings and arranged for aligning the sheets at a surface of the stack.

17. The arrangement according to claim 16, further including a vibration drive connected to the suction device for vibrating the alignment surface.

18. The arrangement according to claim 17, wherein the suction device has a hollow space and includes a limiting wall for at least partially defining the hollow space and constituting the at least one alignment surface, the hollow space being connectable to a low pressure source.

19. The arrangement according to claim 11, wherein the limiting walls have contact regions in which the limiting walls make contact with one another.

20. The arrangement according to claim 19, wherein the limiting walls include additional openings in the contact regions that have larger cross sections than the cross section of the other air openings.

21. The arrangement according to claim 20, wherein the suction device includes a reducer arranged in the hollow space for at least one of reducing and interrupting air flow in the suction device.

22. The arrangement according to claim 11, wherein the at least one suction device comprises a plurality of suction devices respectively arranged at a surface of the stack opposite the sheet feeder and at surfaces of the stack that are parallel to a direction of sheet-feeding from the sheet feeder to the stack.

23. The arrangement according claim 11, further comprising at least one additional suction device located in a region above the sheet feeding device.

* * * * *